US010314404B2

(12) United States Patent
King et al.

(10) Patent No.: US 10,314,404 B2
(45) Date of Patent: Jun. 11, 2019

(54) ARTICLE OF FURNITURE

(71) Applicant: King Furniture Australia Pty Ltd., Turrella (AU)

(72) Inventors: David King, Turrella (AU); John Levey, Turrella (AU); Ryan Lawson, Turrella (AU); Anastasie Panagopoulos, Turella (AU); Tanya Rechberger, Turrella (AU)

(73) Assignee: King Furniture Australia Pty Ltd., Turrella (AU)

( * ) Notice: Subject to any disclaimer, the term of this patent is extended or adjusted under 35 U.S.C. 154(b) by 44 days.

(21) Appl. No.: 15/513,188

(22) PCT Filed: Aug. 5, 2015

(86) PCT No.: PCT/AU2015/050442
§ 371 (c)(1),
(2) Date: Mar. 22, 2017

(87) PCT Pub. No.: WO2016/044883
PCT Pub. Date: Mar. 31, 2016

(65) Prior Publication Data

US 2017/0295939 A1 Oct. 19, 2017

(30) Foreign Application Priority Data

Sep. 25, 2014 (AU) ..... 2014903825

(51) Int. Cl.
*A47C 7/72* (2006.01)
*A47C 17/86* (2006.01)
(Continued)

(52) U.S. Cl.
CPC ..... *A47C 7/72* (2013.01); *A47C 7/40* (2013.01); *A47C 7/54* (2013.01); *A47C 7/62* (2013.01); *A47C 17/86* (2013.01)

(58) Field of Classification Search
CPC .... A47C 7/72; A47C 7/40; A47C 7/54; A47C 17/86
(Continued)

(56) References Cited

U.S. PATENT DOCUMENTS 6,216,927 B1 4/2001 Meritt
8,203,657 B2 * 6/2012 Vitito ..... B60K 35/00 348/837
(Continued)

OTHER PUBLICATIONS

Oct. 19, 2015—International Search Report and Written Opinion—App No. PCT/AU2015/050442.

*Primary Examiner* — Mark R Wendell
(74) *Attorney, Agent, or Firm* — Banner & Witcoff, Ltd.

(57) ABSTRACT

A rest component (14), (16) for an article of furniture (10) includes a body member (32) defining a plurality of surfaces (34). A cover member (36) is carried by at least one surface (34) of the body member (32) to define a pocket (38) associated with the at least one surface (34), the pocket (38) defining a mouth to enable a user to gain access to an interior of the pocket (38). At least one passage (24) is defined by at least one of the body member (32) and the cover member (36) and opening out into the pocket (38). The passage (24) is configured to accommodate an elongate element which extends through the passage to exit from an operatively bottom region of the body member.

18 Claims, 5 Drawing Sheets

(51) Int. Cl.
*A47C 7/62* (2006.01)
*A47C 7/40* (2006.01)
*A47C 7/54* (2006.01)

(58) Field of Classification Search
USPC ..... 297/188.01
See application file for complete search history.

(56) References Cited

U.S. PATENT DOCUMENTS

| | | | | |
|---|---|---|---|---|
| 9,045,096 | B2 * | 6/2015 | Procter | B60R 11/0235 |
| 2003/0226148 | A1 | 12/2003 | Ferguson | |
| 2010/0231009 | A1 | 9/2010 | Chi | |

* cited by examiner

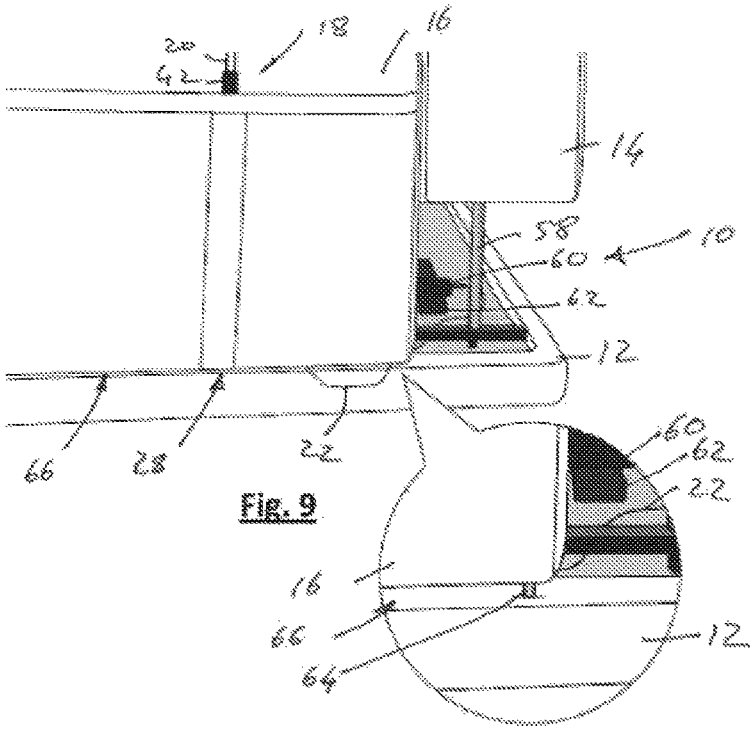
Fig. 9
Fig. 10
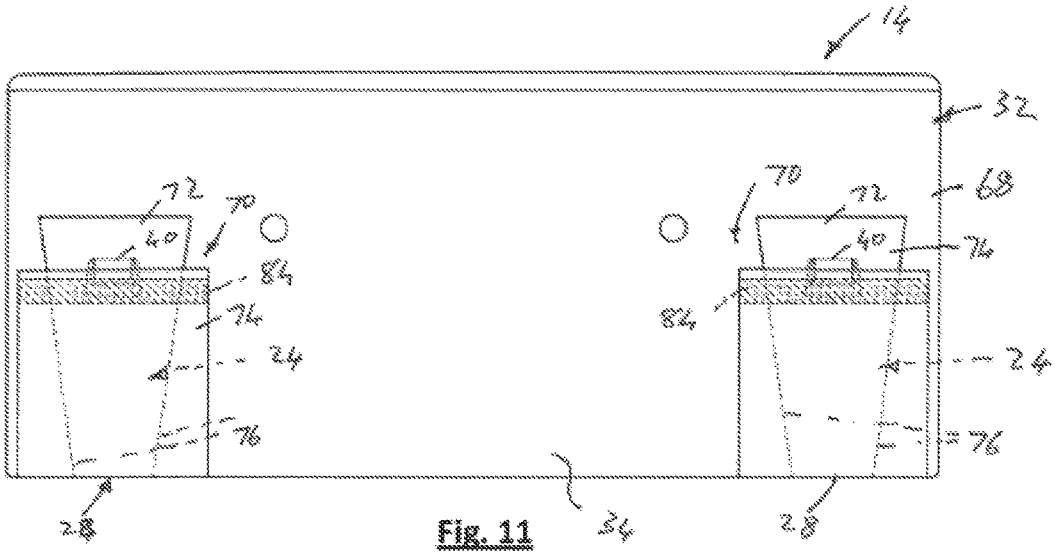
Fig. 11

ARTICLE OF FURNITURE

CROSS-REFERENCE TO RELATED APPLICATIONS

This application is a U.S. National Stage application under 35 U.S.C. § 371 of International Application PCT/AU2015/050442 (published as WO 2016/044883 A1), filed Aug. 5, 2015, which claims the benefit of priority to AU 2014903825, filed Sep. 25, 2014, each of which are hereby incorporated by reference in their entireties.

TECHNICAL FIELD

This disclosure relates, generally, to an article of furniture and, more particularly, to a rest component for an article of furniture, to an article of furniture including the rest component and to an insertion tool for use with the article of furniture.

BACKGROUND

Electrically powered equipment is often used alongside articles of furniture such as armchairs, sofas, chaises, or the like. These items of electrically powered equipment require electrical cables or electrical leads leading to a power source such as a power outlet socket in a wall. The leads or cables can be unsightly reducing the aesthetic appeal of the article of furniture.

Also, the positioning of the electrically powered equipment alongside the articles of furniture makes it more difficult for an occupant to clean around the articles of furniture and the equipment.

SUMMARY

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In a first aspect, there is provided a rest component for an article of furniture, the rest component including a body member defining a plurality of surfaces;

a cover member carried by the body member to define a pocket associated with at least one surface of the body member, the pocket defining a mouth to enable a user to gain access to an interior of the pocket; and at least one passage defined by at least one of the body member and the cover member and opening out into the pocket, the passage being configured to accommodate an elongate element which extends through the passage to exit from an operatively bottom region of the body member.

By "associated with at least one surface of the body member" is meant simply that the pocket is positioned adjacent that surface of the body member irrespective of which parts of the body member and/or cover member define the pocket.

The elongate element may be an electrical cable of an accessory for use with the article of furniture.

The body member may carry at least one receiving formation for receiving a part of an accessory to be mounted to the body member. The at least one receiving formation may be a knock-in arranged within the pocket of the component. It will be appreciated that the rest component may comprise a number of spaced knock-ends arranged in the pocket, each knock-in supporting an accessory.

A bottom of the pocket may run substantially parallel to upper and lower edges of the body member and the bottom of the pocket may be spaced from the lower edge of the body member, an inlet opening to the at least one passage being defined in the pocket.

An exit opening of the passage may be defined at, or adjacent, the lower edge of the body member. In an embodiment, the exit opening may be defined along the lower edge of the body member to be disguised by a seam along the lower edge of the body member to render the outlet opening less obtrusive. In another embodiment, the exit opening may be defined in a bottom region of the body member inwardly of the lower edge. In this latter embodiment, the opening may be concealed behind a flap arranged at the lower region of the body member, the flap, when in its closed position, serving to conceal and guide an electrical cable towards an interior of the article of furniture.

An outer surface of the cover member may carry a gusset-like formation associated with the at least one passage, the gusset-like formation disguising the passage and, in use, the electrical cable in the passage.

In an embodiment, the cover member may be of a multi-layered construction and may be attached to the surface of the body member, the pocket and the passage being formed between layers of the cover member. It will, however, be appreciated that, in other embodiments, the pocket and/or the passage could be formed by a single layered cover member being suitably secured or attached to the surface of the body member with the pocket and/or the passage being defined between a covering layer of the body member and the layer of the cover member.

In another embodiment, the body member may carry a passage defining arrangement which defines the at least one passage. The passage defining arrangement may comprise a plurality of strips of material (tricot fabric) secured together to form the at least one passage. The passage defining arrangement may be carried by foam padding of the body member, the foam padding defining the at least one surface of the body member.

In this embodiment, the cover member may define an aperture in the pocket, the aperture being arranged so that, when the cover member is positioned over the body member, the aperture is in register with the inlet opening of the at least one passage.

In a second aspect, there is provided an article of furniture which includes a platform;

at least one rest component, as described above, arranged on the platform; and an accessory, having an electrical cable, mounted to the at least one rest component, the electrical cable of the accessory extending through the at least one passage of the at least one rest component to exit through an exit opening of the at least one passage.

The article of furniture may include an electrical power source arranged within the platform to which the accessory is connected via its electrical cable to provide power to the accessory. By "within the platform" is meant either that the electrical power source is arranged in the platform itself or that the electrical power source is located within the footprint of the platform.

The article of furniture may include a plurality of rest components, each of which is configured to carry at least one accessory.

At least one of the rest components may be displaceably arranged relative to the platform to enable access to be gained to the power source. At least one further rest component may be arranged in spaced relationship relative to the platform to enable a part of the electrical cable of the accessory protruding through the exit opening of the at least one passage to be tucked between the platform and an operatively bottom surface of the further rest component.

The at least one further rest component may carry a plurality of spacer elements on the operatively bottom surface to effect spaced mounting of the at least one rest component relative to the platform. Each spacer element may be in the form of a pin extending from the operatively bottom surface of the rest component.

The article of furniture may include an insertion tool for inserting the electrical cable into the at least one passage to exit through the exit opening of the at least one passage.

The insertion tool may comprise an elongate body having a length exceeding that of the at least one passage, the insertion tool defining an engaging formation at, or adjacent, one end of the body, the engaging formation being configured to hold a part of the electrical cable captive relative to the body of the insertion tool. The engaging formation may be in the form of a slot extending transversely into the body. An internal end of the slot may be enlarged with the electrical cable being received in the enlarged, internal end of the slot, the body of the insertion tool, in use, bearing against an electrical connector carried on a free end of the electrical cable of the accessory.

The disclosure extends also to an insertion tool for use in inserting an electrical cable into a passage, the insertion tool including an elongate body with a slotted engaging formation at, or adjacent, one end of the body, the engaging formation including an enlarged, bulbous internal end.

BRIEF DESCRIPTION OF DRAWINGS

Embodiments of the disclosure are now described by way of example with reference to the accompanying diagrammatic drawings in which:

FIG. 9 shows a perspective, rear view of a part of the article of furniture indicating another embodiment of the electrical connection of the accessory to the power source;

FIG. 10 shows an enlarged view of parts of the article of furniture of FIG. 9, it being noted that part of the electrical cable has been omitted from FIG. 10 for the sake of clarity;

FIG. 11 shows a side view of a body member of another embodiment of a rest component of an article of furniture with a cover member of the rest component omitted;

DETAILED DESCRIPTION OF EXEMPLARY EMBODIMENTS

Figure 1:
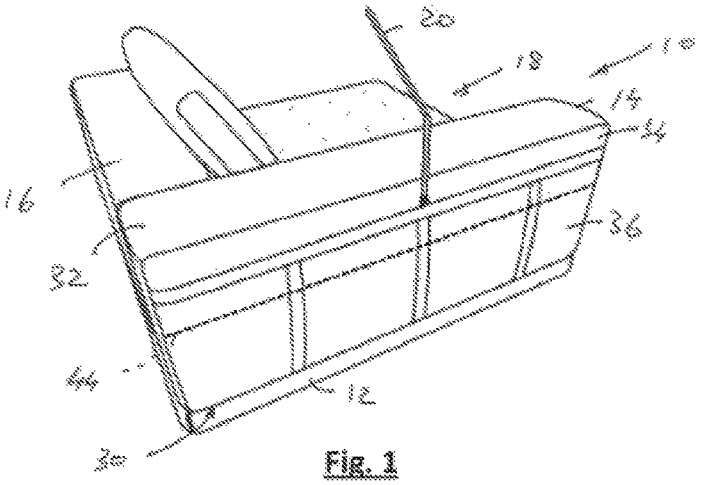
FIG. 1 shows a perspective view of an embodiment of an article of furniture including an electrically powered accessory.

In the drawings, reference numeral 10 generally designates an embodiment of an article of furniture. In the illustrated embodiment, the article of furniture 10 is a chaise and will be referred to as such in the description below. However, it will be appreciated that the article of furniture could adopt other forms such as, for example, a sofa, an armchair, or the like.

The chaise 10 comprises a platform 12 supporting a first rest component in the form of an armrest 14 and a second rest component in the form of a backrest 16. An electrically powered accessory 18 is carried by the armrest 14. In the illustrated embodiment, the electrically powered accessory is in the form of a lamp 20. However, the disclosure is applicable to any accessory 18 which is electrically powered such as, for example, a speaker, a battery charging unit, or the like.

In the embodiment of FIGS. 1-8, the accessory 18 is carried by the armrest 14. In another embodiment, as illustrated in FIGS. 9-10 of the drawings, the accessory 18 is carried on the backrest 16, only a part of the accessory 18 being illustrated in FIG. 9 of the drawings.

Figure 3:
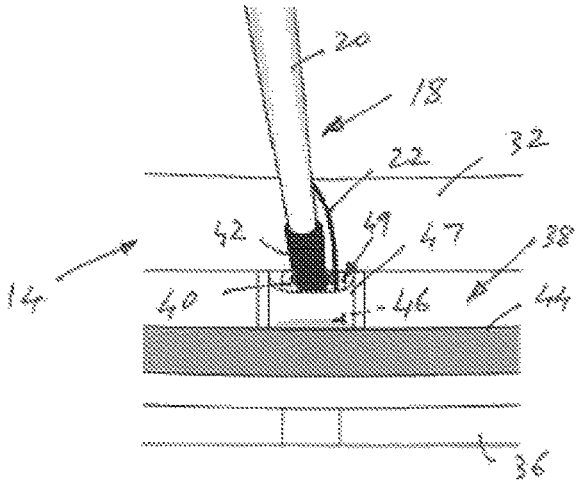
FIG. 3 shows a plan view of a part of the article of furniture illustrating the mounting of the accessory to the article of furniture.
Figure 4:
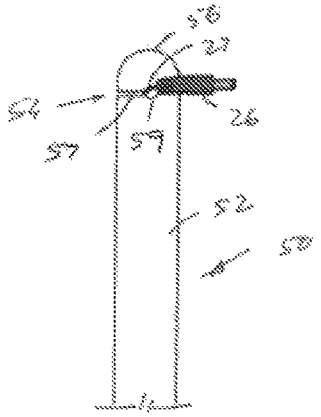
FIG. 4 shows an embodiment of an insertion tool for use in inserting an electrical cable of the accessory into the article of furniture.
Figure 5:
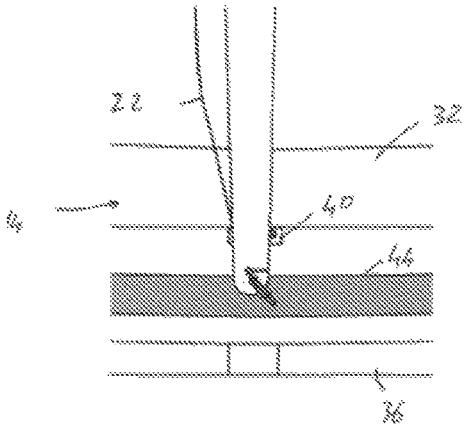
FIG. 5 shows a schematic plan view of an initial step of inserting the electrical cable into the article of furniture.

The lamp 20 includes an electrical cable, or lead, 22 (FIG. 3). As will be described in greater detail below, the lead 22 of the lamp 20 is threaded through a passage 24 (FIG. 7) defined in the armrest 14 such that an electrical connector 26 terminating the lead 22 of the lamp 20 projects through an exit opening 28 (FIG. 7) of the passage 24 in an operatively lower edge 30 of the rest 14.

Figure 2:
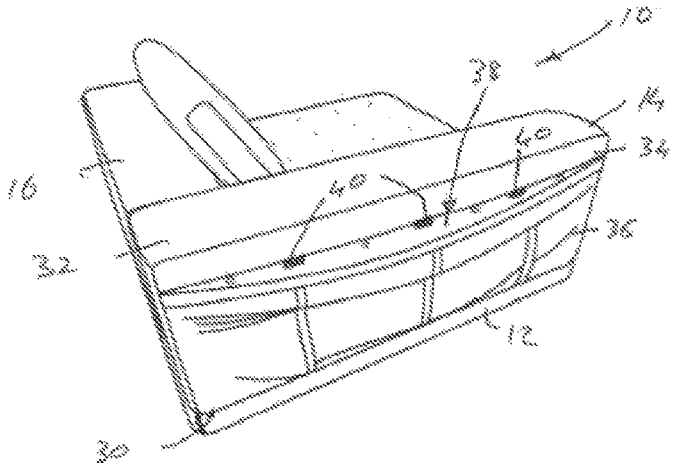
FIG. 2 shows a perspective view of the article of furniture of FIG. 1 with the accessory omitted.

Reverting to FIGS. 1-3 of the drawings, an embodiment of the armrest 14 is now described in greater detail. The rest 14 includes a body member 32 having an operatively outer surface or side 34. A cover member 36 is received over the body member 32 to cover the body member 32 including the operatively outer side 34 of the body member 32. The cover member 36 is of a double layered construction to define a pocket 38. A plurality of receiving formations, or knock-ins, 40 are arranged at spaced intervals in the pocket 38. The lamp 20 is mounted to an attachment member in the form of a bracket 42, the bracket 42 being received in one of the knock-ins 40 to retain the lamp 20 in position relative to the armrest 14.

Internal layers of the cover member 36 are sewn together below a top edge of the cover member 36 to form a seam 44. The seam 44 forms a bottom of the pocket 38 as shown in FIG. 3 of the drawings. An opening 46 is formed in the pocket 38, the opening 46 forming an inlet opening of the passage 24. In this embodiment, the passage 24 is formed between the layers of the cover member 36.

Further, in this embodiment and as shown most clearly in FIG. 3 of the drawings, a covering strip 47 extends between the knock-in 40 and the opening 46 of the passage 24. The covering strip 47 defines a conduit 49 through which the lead 22 is threaded prior to insertion into the passage 24. This improves the aesthetics of the interior of the pocket 38 and also minimises the risk of an item stored in the pocket 38 snagging on the lead 22. A bottom of the strip 47 is sewn closed to the seam 44 to inhibit objects falling into the opening 46.

To facilitate insertion of the lead 22 into the passage 24, an insertion tool 50 (FIG. 4) is provided with the article of furniture 10. The insertion tool 50 is a substantially rigid device made of a suitable synthetic plastics material or metal. The insertion tool 50 comprises an elongate body 52 defining a slotted engaging formation 54 proximate an end 56 of the body 52. The length of the body 52 of the insertion tool 50 exceeds the length of the passage 24 so that, when the insertion tool is inserted into the passage 24 it can be manipulated so that the end 56 of the tool 50 protrudes through the exit opening 28 while an opposed end (not shown) of the body 52 of the tool 50 extends out of the inlet opening 46 and the conduit 49 into the pocket 38 where it can be manipulated by a user.

The engaging formation 54 is substantially keyhole-shaped having a transversely extending slot 57 leading into an enlarged, internally arranged bulbous formation 59. In use, the electrical lead 22 of the lamp 20 is inserted into the engaging formation 54 so that the lead 22 is received in the bulbous formation 59 and the body 52 bears against the connector 26 of the lead 22.

Figure 6:
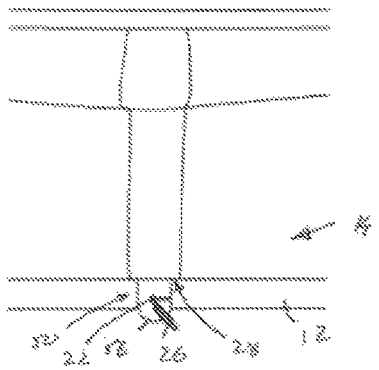
FIG. 6 shows a schematic front view of the insertion of the electrical cable through a passage of the article of furniture to protrude out of an exit opening of the passage.
Figure 7:
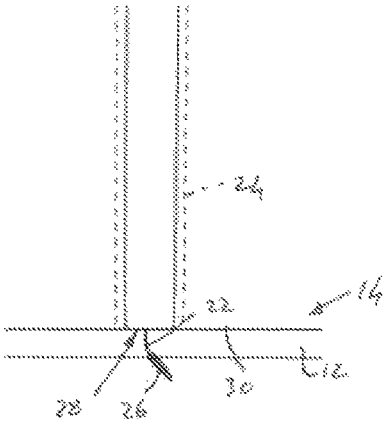
FIG. 7 shows a schematic front view of the electrical cable after removal of the insertion tool.

The end 56 of the body 52 of the insertion tool 50 is inserted into the conduit 49. The insertion tool 50 is pushed through the passage 24 until the end 56 of the insertion tool 50 protrudes through the exit opening 28 of the passage as shown in FIG. 6 of the drawings. The lead 22 is then disengaged from the engaging formation 54 of the insertion tool 50 and the insertion tool 50 is withdrawn from the passage 24.

In another embodiment, the electrical lead 22 is inserted into the passage 24 from the bottom up, i.e. via the insertion tool 50 being inserted into the opening 28 of the passage 24 at the bottom of the body member 32 of the armrest 14 with the insertion tool 50 exiting through the conduit 49. This will apply, for example, where the accessory has an electrical plug associated with it which may be too large to fit through the passage 24.

Figure 8:
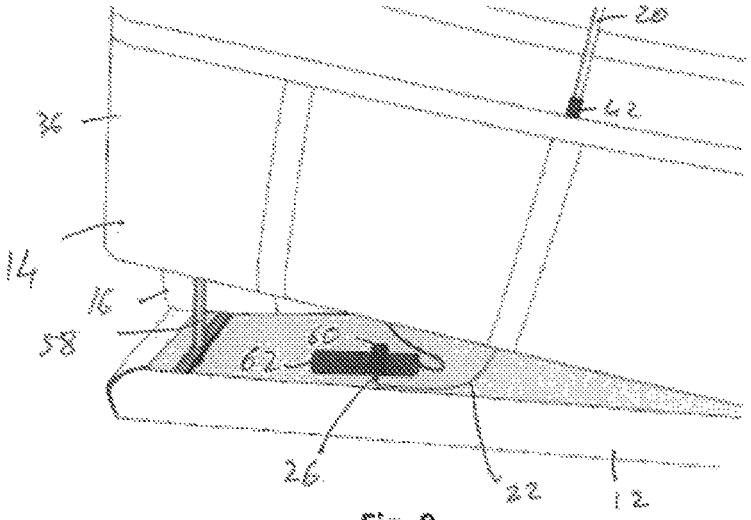
FIG. 8 shows a perspective, side view of a part of the article of furniture illustrating an embodiment of the electrical connection of the accessory to a power source.

The armrest 14 is pivotally supported on the platform 12 and is retained in position by a pair of spaced pivoting rods, one of which is shown at 58 in FIG. 8 of the drawings. These rods 58 can pivot to a position in which they lie within the plane of the platform 12. Once the lead 22 of the lamp 20 has been inserted through the passage 24, the lead 22 is connected to an electrical plug 60 which, in turn, is plugged into an electrical power source in the form of a power board 62 contained within the platform 12 of the chaise 10. As defined, the term "within the platform" is to be understood as either that the power board 62 is built into the platform 12 or that it lies within the footprint of the platform 12.

In the embodiment shown in FIGS. 9 and 10 of the drawings, the lamp 20 is mounted to the backrest 16 of the article of furniture 10. The backrest 16, unlike the armrest 14, is fixedly secured to the platform 12. In other words, the backrest 16 does not pivot or is not otherwise displaceable relative to the platform 12.

In this embodiment, the backrest 16 is spaced from the platform 12 by a plurality of spaced pins, one of which is shown at 64 in FIG. 10 of the drawings. Typically a pin 64 is arranged at, or adjacent, each lower corner of the backrest 16. The backrest 16 is, otherwise, configured in the same manner as the armrest 14 and includes the passage (although not shown in FIG. 9 of the drawings). Hence, once the lead 22 of the lamp 20 has been threaded through the passage 24 and extends through the exit opening 28 of the passage 24, the lead is tucked into a gap 66 defined between a bottom of the backrest 16 and a top of the platform 12, the gap 66 being shown on an exaggerated scale for greater clarity in FIG. 10 of the drawings. As described above, part of the lead 22 is omitted from FIG. 10 to show the pin 64.

As is the case with the armrest 14, the connector 26 of the lamp 20 is then inserted into a plug 60 which, in turn, is inserted into the power board 62 to provide power to the lamp 20. This is done in the same way as is done with the armrest 14 by pivoting the armrest 14 relative to the platform 12, as shown in FIG. 9 of the drawings, to enable access to be gained to the power board 62.

In the illustrated embodiment, the chaise 10 has an extensible seat base associated with it, the seat base being retractable into the backrest 16. Thus, the backrest 16 is fixedly secured to the platform 12. However, in an embodiment where the seat base is fixed and, for example, secured directly to the platform 12, the backrest 16, like the armrest 14, may be pivotally mounted on the platform 12. Where the backrest 16 is pivotally arranged on the platform 12, the pins 64 are omitted.

Referring now to FIGS. 11-15 of the drawings, another embodiment of the article of furniture 10 and, in particular, a rest component, in the form of an armrest 14, of the article of furniture 10 is illustrated and is described in greater detail. With reference to previous drawings, like reference numerals refer to like parts, unless otherwise specified.

In FIG. 11 of the drawings, the body member 32 of the armrest 14 is illustrated with the cover member 36 removed to reveal the outer side 34 of the body member 32. The outer side 34 is defined by foam padding 68 of the body member 32. The foam padding 68 of the body member 32 carries a plurality of passage defining arrangements 70 on it. In the illustrated embodiment, two such passage defining arrangements 70 are shown but it will be appreciated that a greater or fewer number of passage defining arrangements 70 may be carried by the foam padding 68 of the body member 32.

Each passage defining arrangement 70 comprises a pair of strips 72, 74 of a suitable fabric material. For example, the strips 72, 74 are of a tricot material. The strips 72 and 74 of each passage defining arrangement 70 are sewn together, as shown by seams 76, to form the passage 24 and its associated exit opening 28. The strips 72, 74 are, in turn, secured to the side 34 of the foam padding 68, for example, by adhesive. It is noted that the outer strip 74 overlies the knock-in 40.

Figure 12:
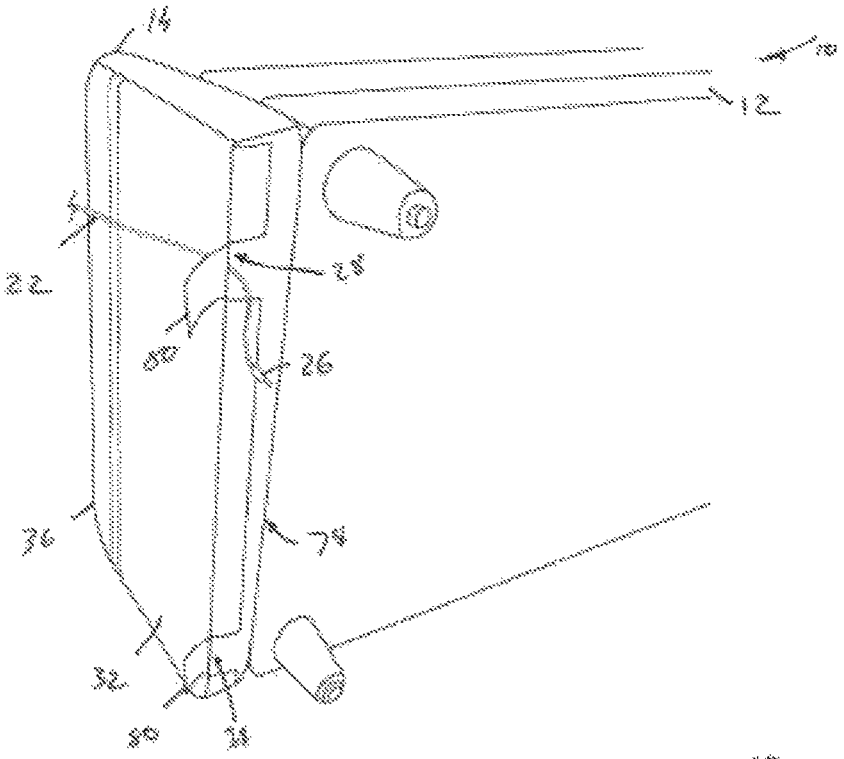
FIG. 12 shows a perspective view, from below, of the article of furniture including the rest component of FIG. 11 with its cover member mounted in position and showing the insertion of the electrical cable into the article of furniture.
Figure 13:
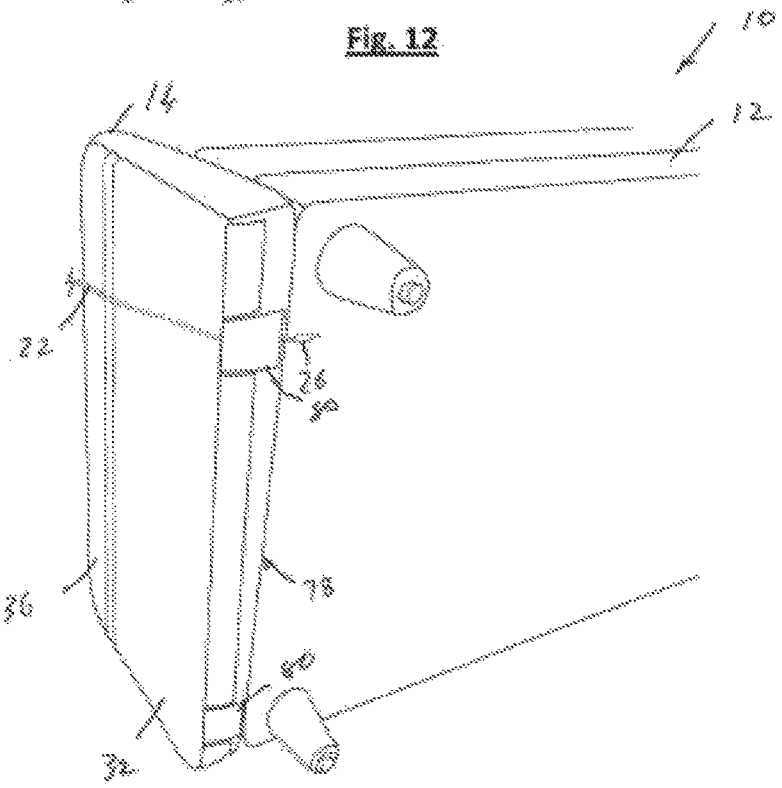
FIG. 13 shows a perspective view, from below, of the article of furniture showing further how the electrical cable is located relative to the rest component.

In FIGS. 12 and 13 of the drawings, the armrest 14 is shown mounted in position on the article of furniture 10. In addition, the cover member 36 of the armrest 14 is shown in position over the body member 32. Unlike in the previous embodiment, the exit opening 28 of the passage 24 is not concealed by a seam but, instead, is arranged inwardly of a lower edge of the body member 32. The cover member 36 is secured about the body member 32 by strips of hook and loop material, such as that sold under the registered trade mark Velcro, arranged at a lower region 78 of the cover member 36 to secure the cover member 36 about the body member 32.

Two of these strips form flaps 80, a flap 80 being associated with each passage defining member 70 of the body member 32. Once the electrical lead 22 has been inserted through the passage 24 and protrudes through the exit opening 28 of its associated passage 24, the flap 80 associated with that passage 24 is moved from the position shown in FIG. 12 of the drawings to the position shown in FIG. 13 of the drawings. As illustrated, the flap 80, when in its closed position, as shown in FIG. 13 of the drawings, conceals the outset opening 28 of the passage 24 and guides the electrical lead 22 inwardly towards the platform 12 of the article of furniture 10 so that the lead 22 is concealed beneath the article of furniture.

Figures 14, 15:
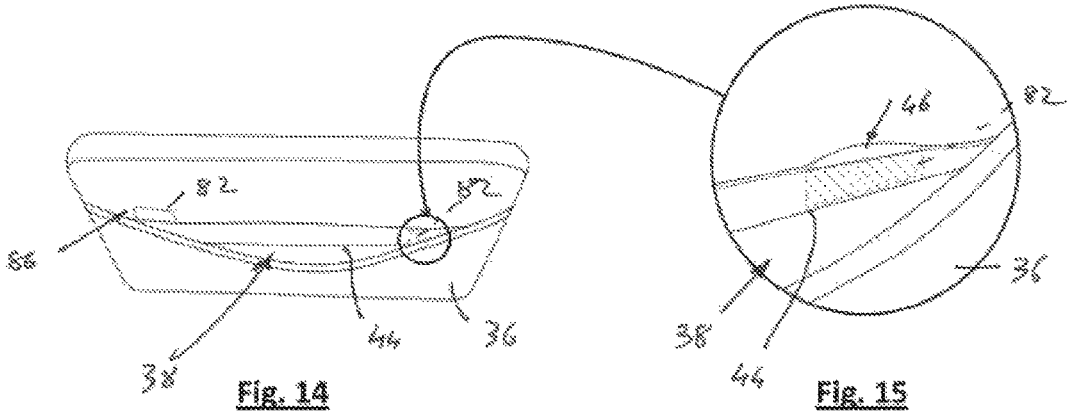
FIG. 14 shows a perspective view of a cover member of the rest component of FIG. 11.
FIG. 15 shows, on an enlarged scale, the part of the cover member of FIG. 14 circled by Circle 'A' in FIG. 14.

Referring now to FIGS. 14 and 15 of the drawings, the cover member 36 is shown in greater detail. As in the preceding embodiment, the cover member 36 defines the pocket 38. In this embodiment, the opening 46 to the passage 24 is offset with respect to the seam 44 of the pocket 38. The cover member 36 carries a plurality of securing tabs 82, one associated with each passage defining arrangement 70 and, accordingly, each passage 24.

Each tab 82 is of a component part of hook and loop material, such as that sold under the registered trade mark Velcro. This component part is able to grip the tricot strip 74 of its associated passage defining arrangement 70 or, if not, the tricot strip 74 carries a transversely extending strip of a complementary part 84 to mesh with and engage the tab 82.

When the cover member 36 is placed over the body member 32, the tabs 82 are in the position shown at 86 in FIG. 14 of the drawings, i.e. projecting upwardly and outwardly from adjacent the opening 46. Each tab 82 is then inserted into the opening 46 by turning the tab 82 through 180° so that the tab 82 engages either the tricot strip 74 itself or the complementary part 84 of hook or loop material carried by the strip 74. In this way, access to the knock-in 40 is facilitated as well as access to the passage 24.

As described above, although the embodiments have been described with reference to the accessory 18 being a lamp 20, the accessory 18 could be any other electrically powered device such as a speaker, a battery charging unit, or the like.

It is therefore an advantage of the disclosure that a rest component for an article of furniture as well as an article of furniture incorporating the rest component is provided which lends itself for use in rooms where space is at a premium. It also facilitates the use of electrical accessories in a compact and aesthetically pleasing manner since the electrical leads of the accessories are concealed within the article of furniture.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A rest component for an article of furniture, the rest component comprising:

a body member defining a plurality of surfaces and parallel, operatively upper and lower edges;

a cover member carried by the body member and covering at least part of the body member;

a pocket defined within the cover member and associated with at least one surface of the body member, the pocket defining a mouth to enable a user to gain access to an interior of the pocket, a bottom of the pocket extending parallel to the operatively upper and lower edges of the body member, the bottom of the pocket being spaced from the operatively lower edge to be closer to the operatively upper edge than the operatively lower edge of the body member; and at least one elongate passage defined by at least one of the body member and the cover member with an inlet opening of the at least one passage opening out into the pocket and an exit opening of the at least one passage being defined proximate the lower edge of the body member, the at least one passage being configured to accommodate an elongate element which extends through the at least one passage to exit through the exit opening from an operatively bottom region of the body member.

2. The component of claim 1 in which the body member carries at least one receiving formation for receiving a part of an accessory to be mounted to the body member.

3. The component of claim 1 in which the inlet opening of the at least one passage is defined in the pocket at, or proximate, the bottom of the pocket.

4. The component of claim 1 in which the exit opening of the at least one passage is defined in a bottom region of the body member inwardly of the lower edge.

5. The component of claim 4 in which the exit opening is concealed behind a flap arranged at the lower region of the body member, the flap, when in its closed position, serving to conceal and guide an electrical cable towards an interior of the article of furniture.

6. The component of claim 1 in which an outer surface of the cover member carries a gusset-like formation associated with the at least one passage, the gusset-like formation disguising the passage and, in use, the electrical cable in the passage.

7. The component of claim 1 in which the pocket and the passage are formed between layers of the cover member.

8. The component of claim 1 in which the body member carries a passage defining arrangement which defines the at least one passage.

9. The component of claim 8 in which the passage defining arrangement comprises a plurality of strips of material secured together to form the at least one passage.

10. The component of claim 8 in which the cover member defines an aperture in the pocket, the aperture being arranged so that, when the cover member is positioned over the body member, the aperture is in register with the inlet opening of the at least one passage.

11. An article of furniture comprising:

a platform;

at least one rest component, as claimed in claim 1, arranged on the platform; and an accessory, having an electrical cable, mounted to the at least one rest component, the electrical cable of the accessory extending through the at least one passage of the at least one rest component to exit through the exit opening of the at least one passage.

12. The article of furniture of claim 11 which includes an electrical power source arranged within the platform to which the accessory is connected via its electrical cable to provide power to the accessory.

13. The article of furniture of claim 12 which includes a plurality of rest components, each of which is configured to carry at least one accessory.

14. The article of furniture of claim 13 in which at least one of the rest components is displaceably arranged relative to the platform to enable access to be gained to the power source.

15. The article of furniture of claim 13 in which at least one further rest component is arranged in spaced relationship relative to the platform to enable a part of the electrical cable of the accessory protruding through the exit opening of the at least one passage to be tucked between the platform and an operatively bottom surface of the further rest component.

16. The article of furniture of claim 15 in which the at least one further rest component carries a plurality of spacer elements on the operatively bottom surface to effect spaced mounting of the at least one rest component relative to the platform.

17. The article of furniture of claim 11 which includes an insertion tool for inserting the electrical cable into the at least one passage to exit through the exit opening of the at least one passage.

18. The article of furniture of claim 17 in which the insertion tool comprises an elongate body having a length exceeding that of the at least one passage, the insertion tool defining an engaging formation at, or adjacent, one end of the body, the engaging formation being configured to hold a part of the electrical cable captive relative to the body of the insertion tool.

* * * * *